US009434506B2

(12) United States Patent
Takyar

(10) Patent No.: US 9,434,506 B2
(45) Date of Patent: Sep. 6, 2016

(54) PALLET WITH SUPPORT ELEMENTS CONFIGURED AS ONE-PIECE SKIDS AND RELATED METHODS

(75) Inventor: Sanjiv Takyar, Surrey (GB)

(73) Assignee: CHEP TECHNOLOGY PTY LIMITED, Sidney (AU)

( * ) Notice: Subject to any disclaimer, the term of this patent is extended or adjusted under 35 U.S.C. 154(b) by 0 days.

(21) Appl. No.: 14/127,309

(22) PCT Filed: Jul. 12, 2012

(86) PCT No.: PCT/EP2012/063731

§ 371 (c)(1),
(2), (4) Date: Apr. 21, 2014

(87) PCT Pub. No.: WO2013/010920

PCT Pub. Date: Jan. 24, 2013

(65) Prior Publication Data

US 2014/0251189 A1 Sep. 11, 2014

(30) Foreign Application Priority Data

Jul. 15, 2011 (EP) ..... 11174175

(51) Int. Cl.
*B65D 19/38* (2006.01)
*B65D 19/00* (2006.01)

(52) U.S. Cl.
CPC . *B65D 19/0095* (2013.01); *B65D 2519/00029* (2013.01); *B65D 2519/00064* (2013.01); *B65D 2519/00104* (2013.01); *B65D 2519/00134* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00373* (2013.01); *B65D 2519/00378* (2013.01); *B65D 2519/00447* (2013.01); *B65D 2519/00572* (2013.01); *Y10T 29/49947* (2015.01)

(58) Field of Classification Search
CPC ..... B65D 19/0012; B65D 19/0026; B65D 19/0038; B65D 19/0095; B65D 19/0053; B65D 2519/00378
USPC ..... 108/57.17, 57.25, 57.3, 56.1
See application file for complete search history.

(56) References Cited

U.S. PATENT DOCUMENTS 5,809,902 A * 9/1998 Zetterberg ..... 108/51.11
5,967,056 A * 10/1999 Plante ..... 108/56.1

(Continued)

FOREIGN PATENT DOCUMENTS

FR 2 391 115 12/1978
GB 2 265 137 9/1993

(Continued)

*Primary Examiner* — Daniel J Troy
*Assistant Examiner* — Andres F Gallego
(74) *Attorney, Agent, or Firm* — Allen, Dyer, Doppelt, Milbrath & Gilchrist, P.A.

(57) ABSTRACT

A pallet includes a base layer, a cargo layer and spaced apart support elements positioned between the base layer and the cargo layer and forming a gap therebetween for receiving a lifting member. The cargo layer includes a pair of spaced apart connector boards and a pair of spaced apart end deck boards orthogonal to the pair of connector boards. Each support element extends in length between the pair of spaced apart end deck boards and is configured as a one-piece skid, and includes an open recessed channel therein to receive a respective connector board from the cargo layer.

12 Claims, 5 Drawing Sheets

(56) References Cited

U.S. PATENT DOCUMENTS

| | | | |
|---|---|---|---|
| 2004/0094073 | A1 | 5/2004 | Lacabanne |
| 2004/0139593 | A1 | 7/2004 | Hamilton |

FOREIGN PATENT DOCUMENTS

| | | | |
|---|---|---|---|
| JP | 03256846 A | * | 11/1991 |
| NL | 1 010 922 | | 7/2000 |

* cited by examiner

PALLET WITH SUPPORT ELEMENTS CONFIGURED AS ONE-PIECE SKIDS AND RELATED METHODS

FIELD OF THE INVENTION

The present invention relates to the field of pallets, and more particularly, to a pallet having an improved resilience to impacts from material handling equipment while still supporting a nominal load capacity, and to related methods for making the same.

BACKGROUND OF THE INVENTION

Conventional wood pallets include a base layer and a cargo layer separated therefrom by support blocks. The cargo layer has end deck boards assembled on connector boards that run the full length or width of the pallet. The end deck boards are coupled through the connector boards to the support blocks to build the primary structure of the pallet. The end deck boards are also known as lead boards, and the connector boards are also known as stringer boards. The base layer has end deck boards coupled to the support blocks.

To move the wooden pallets with cargo thereon, the lifting members of material handling equipment, such as fork lift tines from a forklift, are inserted into the gaps between the base and cargo layers. If the forklift is not stopped in time, the forklift crashes into one of the end deck boards of the pallet. Impacts such as this weaken the pallet and greatly shorten the lifespan of the pallet, thereby causing the pallet to be repaired more frequently and/or removed from service before its anticipated life cycle has been reached.

One approach for improving the resilience to impacts from material handling equipment is disclosed in FR 26600283, which provides separate support elements made out of plastic that have notches formed therein to receive connector boards from the cargo layer. The connector boards are positioned edgewise.

Another approach is disclosed in GB 2080763 which provides a support element configured as an elongated block of low density cellular material, such as polystyrene. An upper surface of the support element includes a sheet of stiffening material, and a corresponding lower surface also includes a sheet of stiffening material. The sheets of stiffening material may be wood, for example. An adhesive or other bonding material may be used to secure the sheets of stiffening material to the support element.

Yet another approach is disclosed in GB 2265137 which provides a plastic pallet comprising three spaced apart support elements that are linked together by three base plank members. The base plank members are orthogonal to the support elements. Supported by the support elements is a plurality of beams. Each of the support elements is an elongated member having on its upper surface a series of upstanding ribs and on its lower surface three recesses integrally connected together by sections. The beams are positioned between the ribs and bridge the three support elements while the base plank members located in the recesses bridge the support elements. Each support element comprises a one-piece member composed of a plastic material. Each beam is a hollow extruded member. The base plank members are also hollow extruded members.

Even in view of the above-described pallets, there is still a need to lengthen the lifespan of a pallet by improving its resiliency to impacts from material handling equipment.

SUMMARY OF THE INVENTION

In view of the foregoing background, it is therefore an object of the present invention to provide a pallet that has improved resiliency to impacts from material handling equipment while maintaining support of nominal load capacities.

This and other objects, advantages and features in accordance with the present invention are provided by a pallet comprising a base layer and a cargo layer, with the cargo layer comprising a pair of spaced apart connector boards and a pair of spaced apart end deck boards orthogonal to said pair of connector boards. The pallet may further comprise a plurality of spaced apart support elements positioned between the base layer and the cargo layer and forming a gap therebetween for receiving a lifting member, with each support element extending in length between the pair of spaced apart end deck boards and configured as a one-piece skid, and including an open recessed channel therein to receive a respective connector board from the cargo layer.

Each support element may comprise a connector board receiving area, and a plurality of spaced apart support blocks integrally formed with the connector board receiving area and contacting the base layer. The connector board receiving area may include the open recessed channel that is to receive the respective connector board. The connector board receiving area may also comprise spaced apart sidewalls adjacent sidewalls of the respective connector board received therein, and open ends exposing ends of the respective connector board.

With the support element configured as one-piece skids and extending the full depth of the pallet, the resiliency to impacts from material handling equipment is improved. This is particularly so with when the support element is molded from plastic. To provide the necessary stiffness so that a support element can support a support of nominal load capacity, the connector board from the cargo is positioned within the open recessed area. Each connector board and each deck board may comprise wood.

The open recessed channel in each support element may have a depth equal to a thickness of the connector board placed therein so that an outer exposed surface of the connector board is coplanar with an outer exposed surface of the support element.

Each support element may further comprise a pair of backstops positioned immediately adjacent a respective end deck board. This further increases the resiliency of the pallet to impacts from material handling equipment, as well as improving the structural rigidity. When an impact force is applied to an end deck board, the backstops advantageously absorb the impact force instead of the fasteners used to secure the end deck boards to the support elements. The backstops may be integrally molded with each support element.

The cargo layer may further comprise a plurality of intermediate deck boards between the pair of end deck boards. The cargo layer may further comprise at least one intermediate connector board. The pallet may further comprise at least one intermediate support element positioned between the base layer and the cargo layer and extending in length between the pair of spaced apart end deck boards and configured as a one-piece skid, and including an open recessed channel therein to receive the at least one intermediate connector board.

The base layer may comprise a pair of spaced apart bottom end deck boards extending across the plurality of spaced apart support elements in a same direction as the end deck boards in the cargo layer, and at least one intermediate bottom deck board between the pair of bottom end deck boards.

Yet another aspect is directed to a method for making a pallet as described above. The method may comprise providing the plurality of spaced apart support elements, with each support element extending in length between the pair of spaced apart end deck boards and configured as a one-piece skid, and including an open recessed channel therein. A respective connector board of the cargo layer may be positioned in each open recessed channel of the plurality of spaced apart support elements. The method may further comprise fastening the pair of spaced apart end deck boards of the cargo layer to a top side of the plurality of spaced apart support elements, and fastening the pair of spaced apart bottom end deck boards of the base layer to a bottom side of the plurality of spaced apart support elements.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate alternative embodiments.

Figure 1:
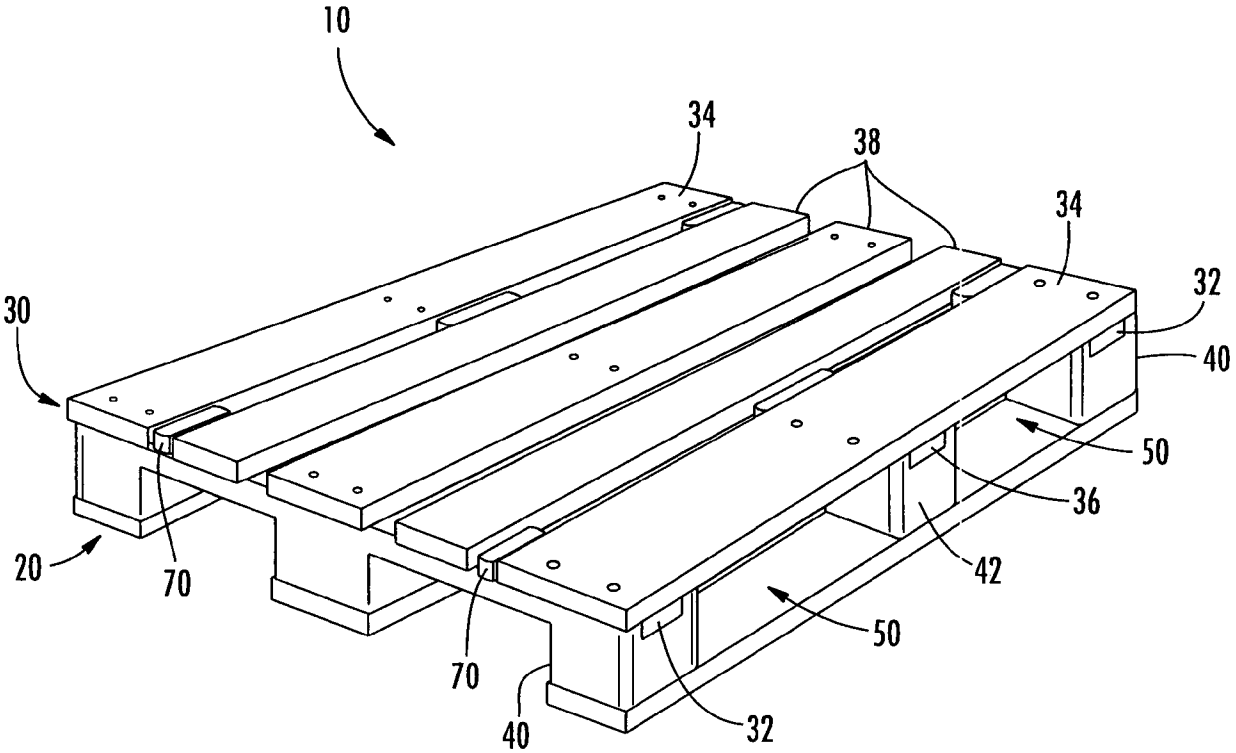
FIG. 1 is a perspective view of a pallet in accordance with the present invention.
Figure 2:
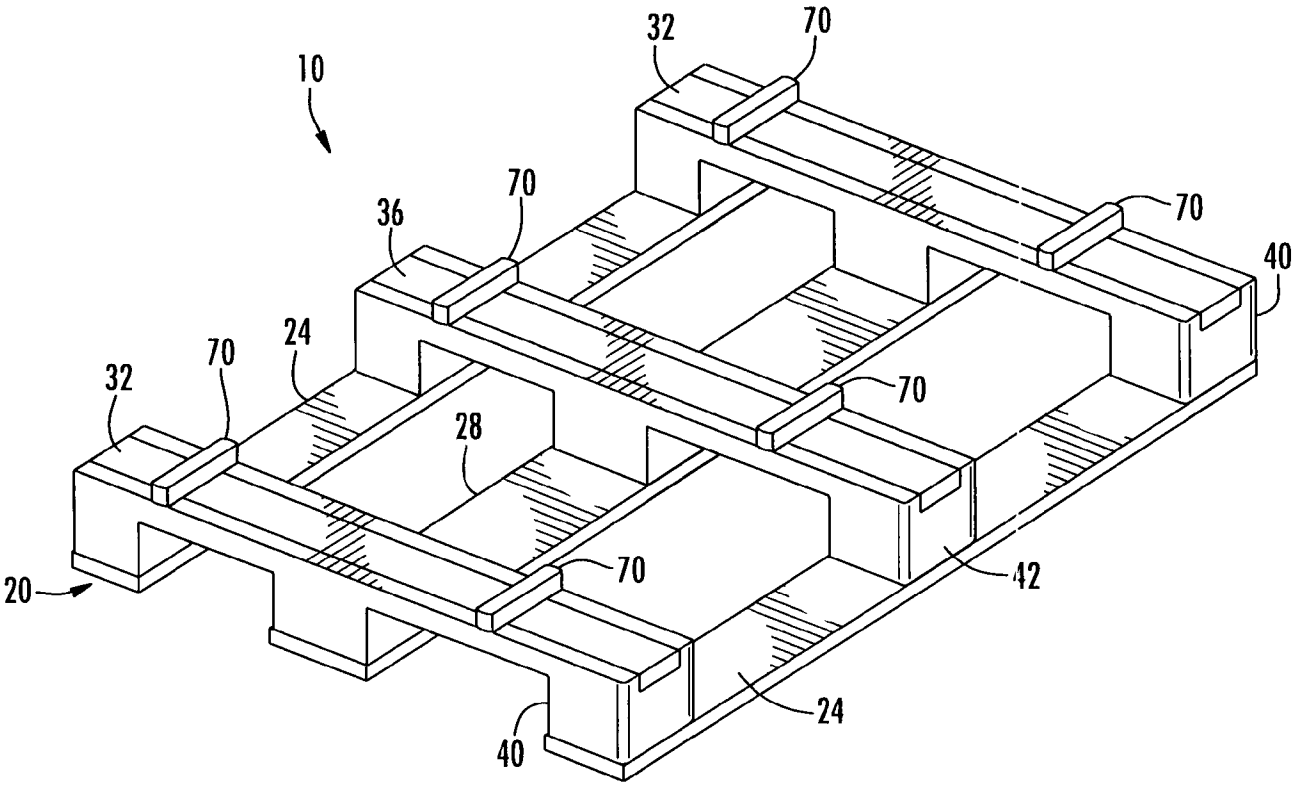
FIG. 2 is a perspective view of the pallet shown in FIG. 1 without the end deck boards and intermediate deck boards from the cargo layer.

Referring initially to FIGS. 1 and 2, a pallet 10 comprises a base layer 20, a cargo layer 30, and spaced apart support elements 40 positioned between the base and cargo layers to define a space 50 therebetween for receiving the lifting members of material handling equipment, such as fork lift tines from a forklift. The cargo layer 30 comprises a pair of spaced apart connector boards 32, and a pair of spaced apart end deck boards 34 orthogonal to the connector boards. The end deck boards 34 are also known as lead boards, and the connector boards 32 are also known as stringer boards.

The illustrated pallet 10 is substantially rectangular shaped. An example size of the pallet 10 is 800 mm deep by 1200 mm wide, with a height of 144 mm. As readily appreciated by those skilled in the art, the pallet 10 is not limited to these dimensions, and may be formed with other dimensions. Moreover, the pallet 10 may be formed having a substantially square shape.

In particular, each support element 40 extends in length between the pair of spaced apart end deck boards 34 and is configured as a one-piece skid. Each support element 40 includes an open recessed channel therein to receive a respective connector board 32 from the cargo layer.

With the support element 40 configured as one-piece skids and extending the full depth of the pallet 10, the resiliency to impacts from material handling equipment is improved. This is particularly so with when the support element 40 is molded from plastic. To provide the necessary stiffness so that a support element 40 can support a nominal load capacity, the connector board 32 from the cargo layer 30 is positioned within the open recessed area 60.

The illustrated pallet 10 also includes at least one intermediate support element 42, and the cargo layer 30 includes at least one intermediate connector board 36, and a plurality of intermediate deck boards 38 between the end deck boards 34. The connector boards 32 are similar in design and function as the intermediate connector board 36.

A perspective view of the pallet 10 without the end deck boards 34 and the intermediate deck boards 38 from the cargo layer 30 is provided in FIG. 2. The base layer 20 includes a pair of spaced apart bottom end deck boards 24 extending across the spaced apart support elements 40, and the intermediate support element 42 positioned therebetween. The bottom end deck boards 24 extend in a same direction as the end deck boards 34 in the cargo layer. The base layer 20 also includes an intermediate bottom deck board 28 between the pair of bottom end deck boards 24.

Normally, pallets include a separated support block positioned between the base and cargo layers to define a space 50 therebetween for receiving the lifting members of material handling equipment. In sharp contrast, with each support element 40 in the illustrated pallet 10 being configured as a one-piece skid, this advantageously combines multiple support blocks into a single component. In this example, three support blocks are being combined into a one-piece skid.

Each support element 40 may be molded from thermoplastic or other polymer materials, including high density polyethylene (HDPE), polypropylene (PP), among other polymer materials. As may be appreciated by those skilled in the art, the polymer materials may be filled or unfilled and/or may include particulate or fibrous, natural or synthetic materials, among other features. For example, unfilled HDPE may provide improved impact strength, PP having strengtheners (e.g., long or short glass fibers, impact modifiers or performance enhancement additives) may provide improved structural properties, and unfilled PP with random copolymers may provide improved reinforcement qualities.

Figure 3:
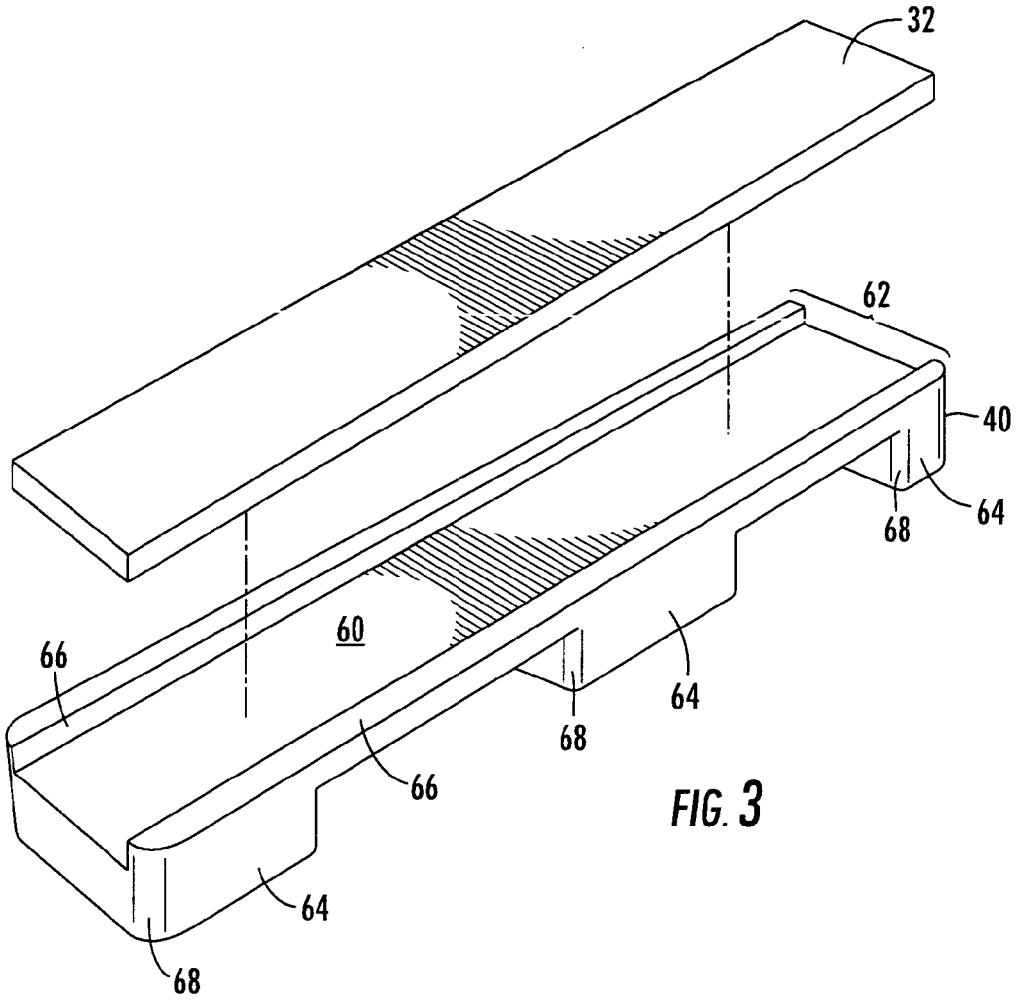
FIG. 3 is a perspective view of a support element with an open recessed channel, and a respective connector board from the cargo layer to be positioned in the open recessed channel in accordance with the present invention.
Figure 4:
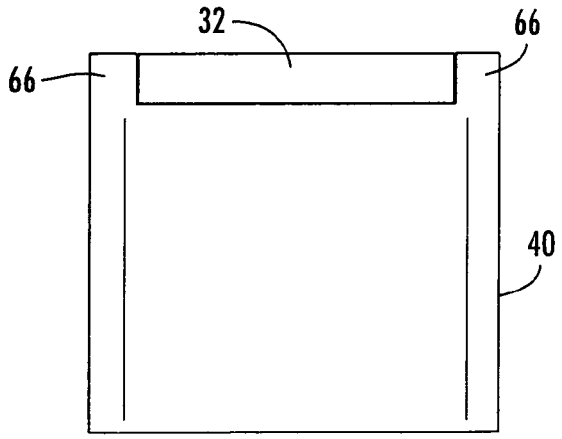
FIG. 4 is a side view of an end of the support element shown in FIG. 3 with the connector board positioned in the open recessed channel.

In order for each support element 40 to provide the necessary stiffness to maintain a desired rate load, such as 1000 kg, for example, a connector board 32 from the cargo layer 30 is placed within an open recessed channel 60, as best illustrated in FIGS. 3 and 4. Although the intermediate support element 42 is not discussed in detail, discussion of the support elements 40 is applicable to the intermediate support element, as readily appreciated by those skilled in the art.

Each support element 40 comprises a connector board receiving area 62, and a plurality of spaced apart support blocks 64 integrally formed with the connector board receiving area. The connector board receiving area 62 includes the open recessed channel 60 that is to receive the respective connector board 32. The connector board receiving area 62 also includes spaced apart sidewalls 66 adjacent sidewalls of the respective connector board 32 received therein, and open ends exposing ends of the respective connector board.

The open recessed channel 60 in each support element 40 has a depth equal to a thickness of the connector board 32 placed therein so that an outer exposed surface of the connector board is coplanar with an outer exposed surface of the sidewalls 66 of the support element, as best illustrated in FIG. 4.

Manufacturing and assembly of the pallet 10 is advantageously simplified with the use of support elements 40 being configured as one-piece skids that also have an open recessed channel 60 for receiving a connector board from the cargo layer 30. As readily appreciated by those skilled in the art, discussion of the support elements 40 is applicable to the intermediate support element 42. The intermediate support element 42 is thus similar in design and function as the other support elements 40.

Since the support elements 40 and the intermediate support element 42 are both formed out of plastic, they have a high impact resistance during impact with the tines of a forklift. In addition, the support element 40 and the intermediate support element 42 may include rounded corners/edges 68 along the perimeter thereof, which also helps to reduce and/or deflect damage during impact with the tines of a forklift, as well as providing an improved aesthetic appearance.

Figure 5:
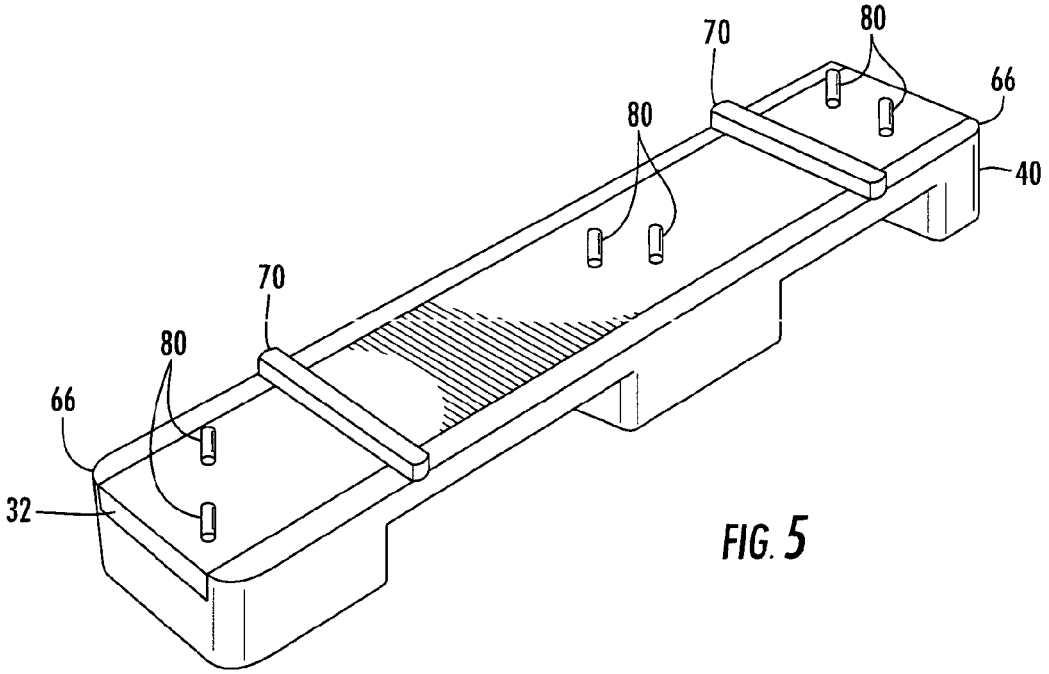
FIG. 5 is a perspective view of a support element with a connector board, with backstops extending across the connector board, and with rivets used to secure the end deck boards and intermediate deck boards to the support element in accordance with the present invention.

To further improve impact resistance and structural rigidity, each support element 40 and the intermediate support element 42 may optionally include a pair of backstops 70 that extend across the width of the connector board 32 or across the width of the intermediate connector board 36, as best shown in FIGS. 2 and 5. Each backstop 70 extends across a width of the open recessed channel and is positioned immediately adjacent a respective end deck board 34. When an impact force is applied to an end deck board 34, the backstops 70 absorb the impact force instead of the fasteners used to secure the end deck boards 34 to the support elements 40.

Figure 6:
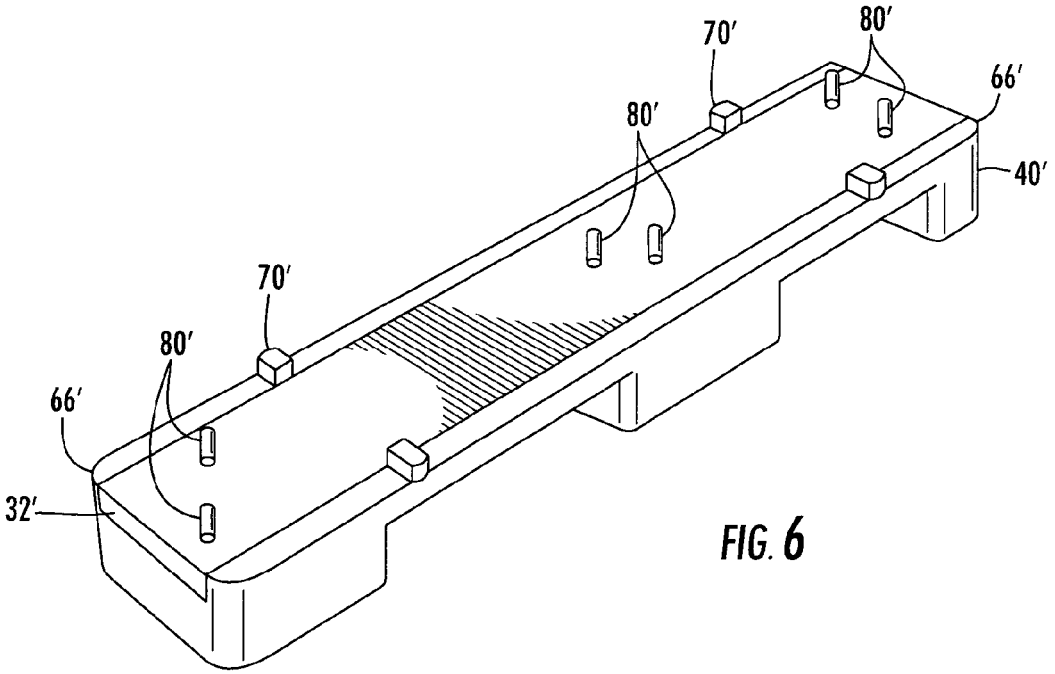
FIG. 6 is a perspective view of another embodiment of the support element shown in FIG. 5 wherein the backstops do not extend across the connector board.

In an alternative embodiment, the backstops 70' do not extend across the width of the connector board 32' or across the width of the intermediate connector board, as best shown in FIG. 6. Instead, the backstops 70' are limited to the sidewalls of the support element 40' and the intermediate support element.

Each backstop 70, 70' embodiment may be integrally formed with the support element 40, 40' and with the intermediate support element 42. In this case, each backstop 70, 70' is molded from the same thermoplastic or other polymer materials used for the support elements 40, 40' and the intermediate support element 42.

Alternatively, each backstop 70, 70' may be separately formed from the support element 40, 40' and from the intermediate support element 42. In this case, the backstops 70, 70' may be molded from different thermoplastics or polymer materials. For example, the backstops 70, 70' may be molded from a first type of thermoplastic or polymer material, while the support elements 40, 40' and the intermediate support element 42 may be molded from a second type of thermoplastic or polymer material.

Fasteners 80 are used to couple the end deck boards 34 to the support elements 40. The fasteners 80 may be rivets, for example. The fasteners 80 may extend all the way through the pallet from the top to the bottom, i.e., from the cargo layer 30 to the base layer 20. Alternatively, the fasteners 80 may extend all the way through the pallet from the bottom to the top, i.e., from the base layer 20 to the cargo layer 30. In addition, some of the fasteners 80 extend from the top to the bottom while some of the fasteners extend from the bottom to the top within the same pallet 10.

The connector boards 32 and end deck boards 34 are pre-drilled with "rivet" holes extending therethrough. Similarly, the support elements 40 are pre-dilled with "rivet" holes for receiving the rivets 80. The rivets 80 allow the end deck boards 34 and the intermediate deck boards 38 to be secured to a top side of the support elements 40 and to the intermediate support elements 42. The intermediate deck boards 38 that are not directly over a support block 64 are coupled to the support element 40 or the intermediate support element 42 using fasteners other than rivets, such as nails or staples, for example.

Rivets 80 are used to secure the bottom end deck boards 24 and the intermediate bottom deck board 28 of the base layer 20 to a bottom side of the support elements 40 and the intermediate support element 42. Other types of fasteners may be used, as readily appreciated by those skilled in the art, such as nails and staples, for example.

Figure 7:
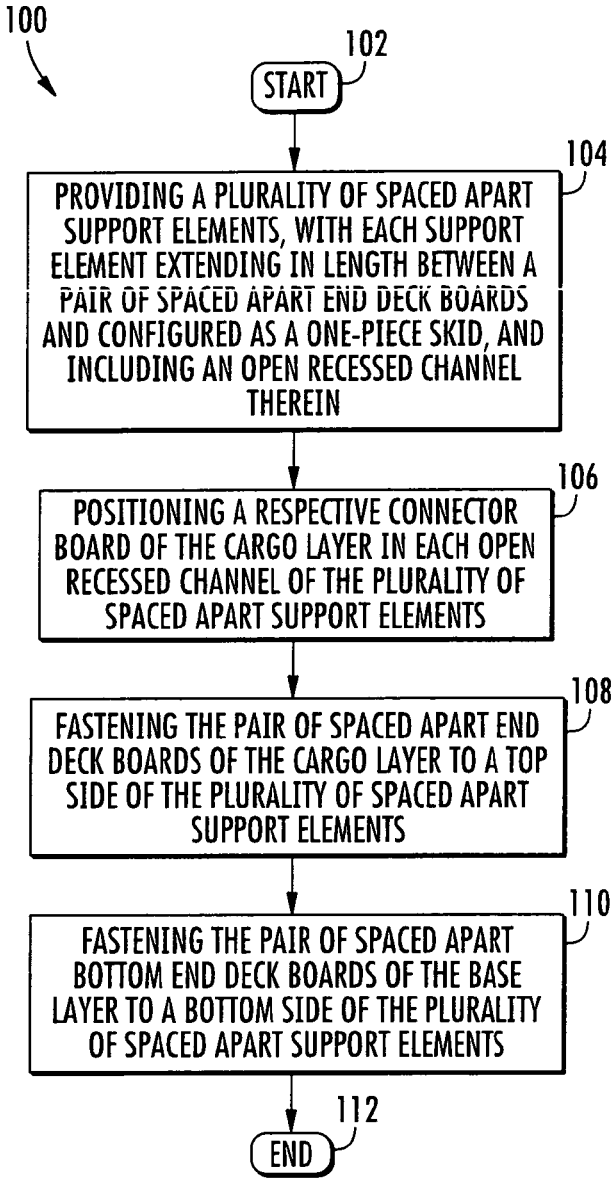
FIG. 7 is a flowchart illustrating a method for making a pallet in accordance with the present invention.

Another aspect is directed to a method for making a pallet 10 as described above. Referring now to the flowchart 100 illustrated in FIG. 7, from the start (Block 102), the method comprises providing the plurality of spaced apart support elements 40 at Block 104, with each support element 40 extending in length between the pair of spaced apart end deck boards 34 and configured as a one-piece skid, and including an open recessed channel 60 therein. A respective connector board 32 of the cargo layer 30 is positioned at Block 106 in each open recessed channel 60 of the spaced apart support elements 40.

The method further comprises fastening the pair of spaced apart end deck boards 34 of the cargo layer 30 to a top side of the spaced apart support elements 40 at Block 108, and fastening the pair of spaced apart bottom end deck boards 24 of the base layer 20 to a bottom side of the spaced apart support elements 40 at Block 110. The method ends at Block 112.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included as readily appreciated by those skilled in the art.

That which is claimed:

1. A pallet comprising:

a base layer;

a cargo layer comprising a pair of spaced apart connector boards and a pair of spaced apart end deck boards orthogonal to said pair of spaced apart connector boards, with each connector board and end deck board being separate from one another;

a plurality of spaced apart support elements positioned between said base layer and said cargo layer and forming a gap therebetween for receiving a lifting member, with each connector board having a length equal to a length of each support element;

with each support element extending in length between said pair of spaced apart end deck boards and configured as a monolithic one-piece skid, and including an open recessed channel having a rectangular shape therein to receive a respective one of said spaced apart connector boards having a rectangular shape, with the open recessed channel in each support element having a depth equal to a thickness of each connector board placed therein so that an uppermost facing horizontal surface of each connector board is coplanar with an uppermost facing horizontal surface of each support element;

with said base layer comprising a pair of spaced apart bottom end deck boards extending across said support elements in a same direction as said pair of spaced apart end deck boards in said cargo layer, and at least one intermediate bottom deck board between said pair of spaced apart bottom end deck boards.

2. The pallet according to claim 1 wherein each support element comprises:

a connector board receiving area; and a plurality of spaced apart support blocks integrally formed with said connector board receiving area and contacting said base layer;

said connector board receiving area including the open recessed channel that is to receive the respective one of said connector boards and comprising spaced apart sidewalls adjacent sidewalls of the respective one of said connector boards received therein, and open ends exposing ends of the respective one of said connector boards.

3. The pallet according to claim 1 wherein each support element further comprises a pair of backstops, with each backstop positioned immediately adjacent respective ones of said spaced apart end deck boards and extending across the width of the open recessed channel.

4. The pallet according to claim 1 wherein each support element further comprises a pair of backstops, with each backstop positioned immediately adjacent respective ones of said spaced apart end deck boards and not extending across the width of the open recessed channel.

5. The pallet according to claim 1 wherein each support element comprises plastic; and wherein each connector board and each deck board comprises wood.

6. The pallet according to claim 1 wherein said cargo layer further comprises a plurality of intermediate deck boards between said pair of spaced apart end deck boards.

7. The pallet according to claim 1 wherein said cargo layer further comprises at least one intermediate connector board; and further comprising at least one intermediate support element positioned between said base layer and said cargo layer and extending in length between said pair of spaced apart end deck boards and configured as a one-piece skid, and including an open recessed channel therein to receive said at least one intermediate connector board.

8. A method for making a pallet comprising a base layer, a cargo layer comprising a pair of spaced apart connector boards and a pair of spaced apart end deck boards, with each connector board and end deck board being separate from one another, and a plurality of spaced apart support elements positioned between the base and cargo layers and forming a gap therebetween for receiving a lifting member, with each connector board having a length equal to a length of each support element, and with the base layer comprising a pair of spaced apart bottom end deck boards and at least one intermediate bottom deck board between the pair of spaced apart bottom end deck boards, characterized in that the method comprises:

providing the plurality of spaced apart support elements, with each support element extending in length between the pair of spaced apart end deck boards and configured as a monolithic one-piece skid, and including an open recessed channel having a rectangular shape therein;

positioning respective ones of said connector boards having a rectangular shape in each open recessed channel of each support element, with the open recessed channel in each support element having a depth equal to a thickness of each connector board placed therein so that an uppermost facing horizontal surface of each connector board is coplanar with an uppermost facing horizontal surface of each support element;

fastening the pair of spaced apart end deck boards of the cargo layer to the uppermost facing horizontal surfaces of the plurality of spaced apart support element, with the pair of spaced apart end deck boards being orthogonal to the pair of spaced apart connector boards; and fastening the pair of spaced apart bottom end deck boards to a bottom side of the plurality of spaced apart support elements in a same direction as the pair of spaced apart end deck boards in the cargo layer, and fastening the at least one intermediate bottom deck board to the bottom side of the plurality of spaced apart support elements between the pair of spaced apart bottom end deck boards.

9. The method according to claim 8 wherein each support element comprises:

a connector board receiving area; and a plurality of spaced apart support blocks integrally formed with the connector board receiving area and contacting the base layer;

the connector board receiving area including the open recessed channel that is to receive the respective one of the connector boards, and comprising spaced apart sidewalls adjacent sidewalls of the respective one of the connector boards received therein, and open ends exposing ends of the respective one of the connector boards.

10. The method according to claim 8 wherein each support element further comprises a pair of backstops, with each backstop positioned immediately adjacent respective ones of the spaced apart end deck boards and extending across the width of the open recessed channel.

11. The method according to claim 9 wherein each support element further comprises a pair of backstops, with each backstop positioned immediately adjacent respective ones of the spaced apart end deck boards and not extending across the width of the open recessed channel.

12. The method according to claim 8 wherein each support element comprises plastic; and wherein each connector board and each end deck board comprises wood.

* * * * *